United States Patent [19]

Prouty

[11] Patent Number: 4,840,577

[45] Date of Patent: Jun. 20, 1989

[54] PLUG LOCKING COVER

[76] Inventor: David Prouty, 72 Thomas Street, Exeter, Ontario, Canada, N0M 1S0

[21] Appl. No.: 101,956

[22] Filed: Sep. 28, 1987

[51] Int. Cl.[4] ..... H01R 13/62

[52] U.S. Cl. ..... 439/373

[58] Field of Search ..... 439/367-373

[56] References Cited

U.S. PATENT DOCUMENTS

| | | | |
|---|---|---|---|
| 2,510,745 | 6/1950 | Kilgore | 439/373 |
| 4,045,108 | 8/1977 | Olsen | 439/368 |
| 4,105,274 | 8/1978 | Casey | 439/368 |
| 4,603,932 | 8/1986 | Heverly | 439/367 |
| 4,618,200 | 10/1986 | Roberts et al. | 439/367 |

FOREIGN PATENT DOCUMENTS

| | | | |
|---|---|---|---|
| 1152176 | 8/1983 | Canada | 439/373 |

*Primary Examiner*—Eugene F. Desmond

[57] ABSTRACT

A releasing engaging means, which is manually manipulated, and is fixably attached over a typical female plug or receptacle that is connected to the mains is used to fixedly hold, a male plug into the receptacle and to inhibit its removal from the receptacle unless the releasing engaging means is manually manipulated, thus inhibiting erroneous removal of the plug as by pulling the cord to which it is attached. Specifically the mechanism provides a "hinged door" mounted in proximity and above the female receptacle. The plug passes through the doors as they swing open and the edge of the doors urge against the plug to hold it in the socket. The doors may be manipulated away from the plug by movement through integral extending tags that are integral to the doors which then release their frictional urging engagement with the plug.

8 Claims, 3 Drawing Sheets

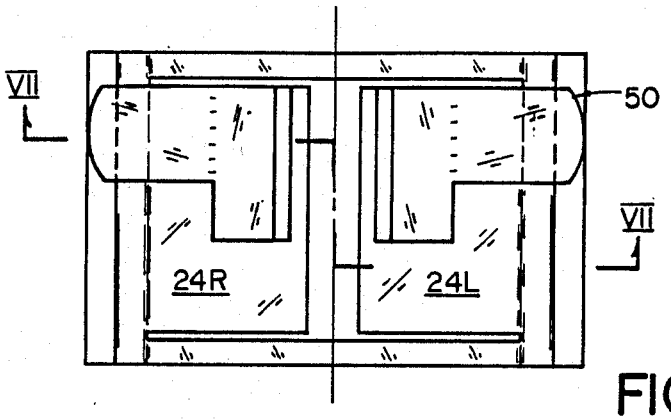
FIG. 6
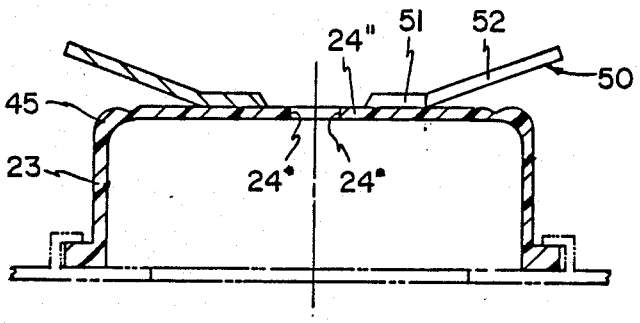
FIG. 7
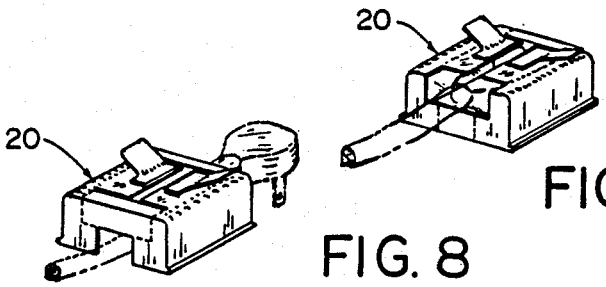
FIG. 8A
FIG. 8

PLUG LOCKING COVER

This invention relates to a novel electrical receptacle plate with means for securing an electrical male plug into engagement with a female receptacle lying subjacent thereto.

In households, the use of electrical appliances with cords and male plugs connected to one end thereof is common. The plug mates into a female socket or receptacle which is electrically connected to the power source or mains in the house. It is common, when the appliance, to which the plug is connected, is moved the wire becomes taut and almost always removes the plug from the receptacle.

It is an object of the invention to provide a novel receptacle cover plate with releasing-engaging means to fixably restrain the plug into the female receptacle while allowing appropriate removal of the plug from the receptacle when the releasing engaging means is manipulated.

The invention will now be described by way of example and reference to the accompanying drawings in which FIG. 1 is a perspective view of a cover plate modified according to the invention.

FIG. 6 is a plan view of an alternative embodiment of the invention.

FIG. 7 is a section along line VII—VII of FIG. 6.

FIGS. 8 and 8A are alternative embodiments of the invention.

Figure 4:
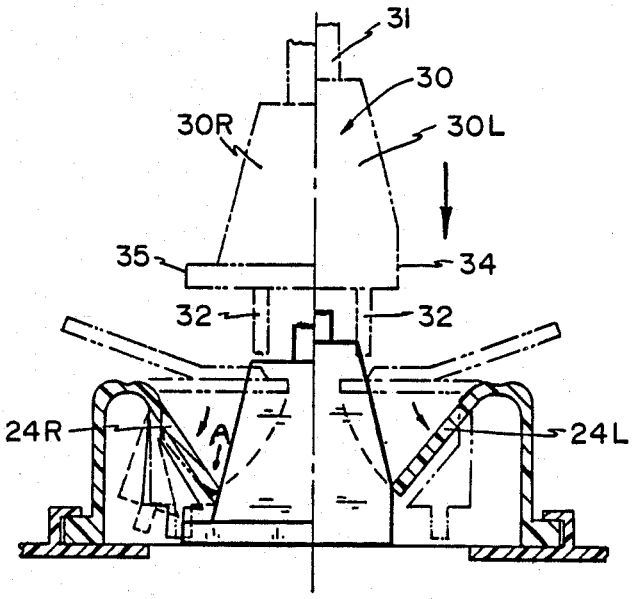
FIG. 4 is a section along lines IV—IV of FIG. 2 showing the commencement of insertion of a plug into the underling receptacle and through the novel engaging releasing means.

Referring to FIG. 4 for a moment, a male household electrical plug 30 is shown, making connection with an electric wire 31 and having its male contacts or prongs 32 extending therefrom. The right hand side 30R of the plug shows an exterior smooth and tapered skirt 34, while the left hand portion 30L a different and modified skirt with a terminal lateral extension 35. The reason for this variation in the skirt profile of the plug is, that plugs of older vintage have both sides profiled as at 30L while plugs of newer vintage have the tag 35 and hence the skirt profile of 30L. My invention works with either vintage of plug.

Figure 1:
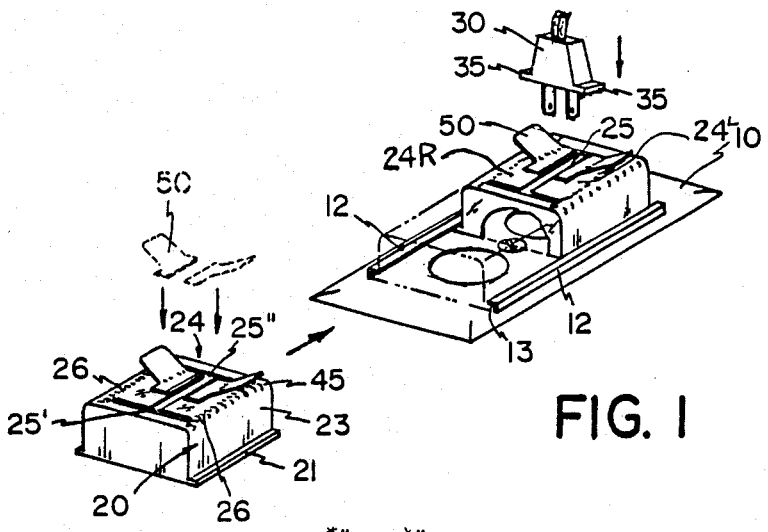

Now referring to FIG. 1, the plug 30 is of the newer vintage with two lateral tags 35. A receptacle plate 10 of the traditional type is shown but has mounted exteriorly thereto opposite longitudinal detents 12 which may be welded or integrally molded to the receptacle plate surface if the receptacle plate 10 be made of plastic. The detents 12 and receptacle plate 10 define there between a track 13. This track 13 accomodates the novel releasing engaging means 20. Ideally two such means 20 are slipped into the tracks 13 so that one registers over the opening for one receptacle and one over the opening for the other receptacle as shown.

Figure 2:
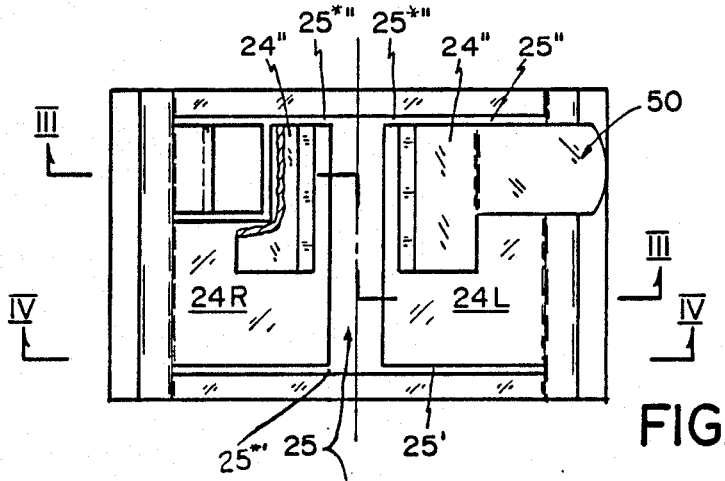
FIG. 2 is a plan view of the cover plate of FIG. 1.

The releasing engaging means 20 is unitarily molded from resilient plastic or the like and has opposite marginal flanges 21 that engage into and mate with the track 13. From these flanges the means has opposite upstanding walls 23 that curve toward each other to form an irregular upper surface generally shown as 24. This surface has a recess or opening in the form of an "H", wherein the profile of the "H" represents a slot or "cutouts" in the upper surface 24. The "H" is generally depicted as 25 and consists of communicating pieces 25' and 25'' which are parallel to each other and extend generally from one wall 23 to the other wall 23 and an interconnect central cutout or slot 25*. The body therefore of the upper surface 24 to the left and right, of the central slot 25* is illustrated in FIGS. 1 and 2 as surfaces 24L and 24R respectively. Each surface 24L and 24R curvingly merges with the adjacent vertical wall 23 (because of its integral molding) through a transitional bend 26 that acts as a "hinge" and allows the surfaces 24L and 24R to bend as "doors" downward toward the receptacle plate 10 as will become apparent.

Figure 3:
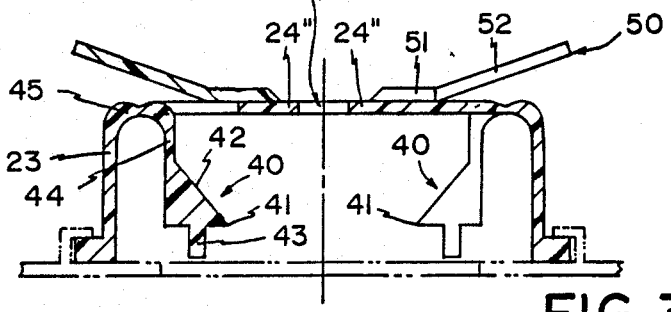
FIG. 3 is a section along lines III—III of FIG. 2.
Figure 5:
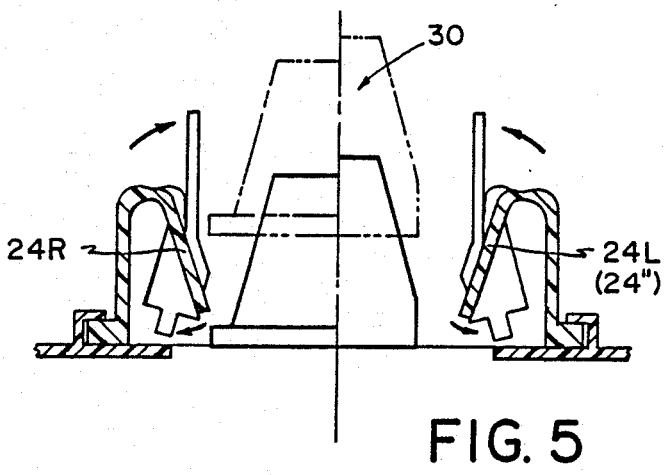
FIG. 5 is the section of FIG. 4 but illustrating the plug in the receptacle, immediately prior to its removal from the novel engaging releasing, showing the means in full disengagement from the plug.

The surfaces 24R and 24L are as will become more apparent generally "L" shaped where the foot of the "L" makes union and is integral with the transitional bend 26 that acts as the hinge while the upper arm designated 24'' in the figures acts as a finger for pushing out of alignment a resiliently biasing and moveable detent generally shown in FIGS. 3 and subsequent as 40 whose central marginal edge 41 is the engaging point against the shoulder of the plug 30 as is apparent from the review of the FIGS. 4 and 5.

The detent 40 has a cross-section, as is clearly seen in FIG. 3, in the form of a trapezoid with inclined upper surface 42, downwardly and outwardly projecting to tip 41 with an integral downward depending tag 43 all of which is supported, and integral to an upwardly depending curvature stem 44 that merges into the side wall 23 through a curving bend 45 that is in plane with the hinge bend 26 integral surfaces 24 and the side wall 23. The fingers 24'' therefore when they swing down as as clearly seen in FIGS. 4 and 5, engage the incline face 42 of the moveable detent 40 and push the detent outward and away, as seen in FIGS. 4 and 5 making clearance for plug insertion or removal as the case might be.

In order to facilitate removal, there is as well, integrally attached to each finger 24'' a wing piece 50 clearly seen as a lower flat piece 51 that inclinedly extends upward into a flat piece 52 that acts as a "push finger" for sliding the doors open as in FIGS. 4 and 5 to remove engagement of the engaging margin 41 of the detent 40 so the plug may be removed. The wing piece 50 therefore can be integrally molded to finger 24'' of door 24 or alternatively may be appropriately welded as those skilled in the art will know.

Referring to FIGS. 6 and 7, the movable detent 40 may, in some applications, being eliminated whereupon the arms 24'' terminate along their marginal edges as 24* and this marginal edge 24* becomes the bearing surface, in a similar fashion as shown in FIG. 4, against the plug 30.

In yet an alternative embodiment of the invention, in order to accomodate integral plugs wherein the power cord is off set but molded to the plug and an accomodating recess 16 may be structured. In this instance however, the cover must be slid on and off in order to affix the plug.

Referring to FIG. 8A if the recess 60 mates with the opening 25 then the type of plug as shown in FIG. 8 can be accommodated in the fashion early described for the other embodiments.

The embodiments of the invention is which an exclusive property of privilege is claimed are defined as follows:

1. In combination with a wall mounted power box carrying a female power receptacle, a cover plate adapted for releasingly engaging the marginal profile of a male electrical plug adapted to be inserted into, thereupon to cause electrical engagement therewith, or to be removed from the female power receptacle whereby the plug is constrainingly engaged into the receptacle by the cover plate, the cover plate comprising:

(a) an outer housing defining an upper essentially flat surface which itself defines a recess in the form of an "H" and hence the upper surface includes fingers, which lie in the plane of the surface, and which project toward each other so that their distal and lateral margins or edges define with the upper flat surface the "H" recess, while proximate ends of each finger merge integrally with and are part of the upper surface;

(b) means on the sides of the housing for fixedly engaging the housing onto the receptacle.

2. The cover plate as claimed in claim 1 wherein the fingers in proximity to their distal ends have upwardly extending detents, disposed in an inclined fashion, adapted to receive a biasing force thereon and to cause movement of the distal ends of the fingers away from each other and hence from engagement with a plug.

3. The cover plate as claimed in claim 1 wherein the housing has an end wall aperture through which a cord may pass to which the plug is electrically connected.

4. The cover plate as claimed in claim 1 wherein the proximal ends of the fingers merge through a resilient region into the integral upper surface and the resilient region urges the fingers toward each other.

5. The cover plate as claimed in claim 4 wherein the proximal ends of the fingers merge through a curved sheet into the surface and hence form a resiient hinge adapted to permit flexation of the fingers out of a plane co-incident with the upper surface.

6. The cover plate as claimed in claim 5 together with a depending detent merging with the under-surface of the said resilient hinge, but depending vertically downward and into a downwardly inclining face that transforms into a lower distal end engaging tip that steps reversingly backwards subjacent the face and into an integral downward depending tag, whereby each hinge disposes oppositely inclined faces with tips at a relative position less than the normal cross-sectional width of a male plug whereby the tips engage the plug and restrain the plug from removal from the female receptacle.

7. The cover plate as claimed in claim 6 wherein the extent of the fingers is such, that when the fingers are biased downward out of the coincident plane with the upper surface they urge against, respectively, the inclined face beneath it and hence move laterally urge the tip away from the male plug, thereby allowing the plug to be removed from the receptacle.

8. The cover plate as claimed in claim 7 wherein the housing has an end wall aperture through which a cord may pass to which the plug is electrically connected.

* * * * *